US011186890B2

(12) United States Patent
Huang et al.

(10) Patent No.: US 11,186,890 B2
(45) Date of Patent: Nov. 30, 2021

(54) TWO-PHASE STEEL AND METHOD FOR THE FABRICATION OF THE SAME

(71) Applicant: THE UNIVERSITY OF HONG KONG, Hong Kong (CN)

(72) Inventors: Mingxin Huang, New Territories (HK); Binbin He, Hong Kong (CN)

(73) Assignee: THE UNIVERSITY OF HONG KONG, Hong Kong (CN)

( * ) Notice: Subject to any disclaimer, the term of this patent is extended or adjusted under 35 U.S.C. 154(b) by 0 days.

(21) Appl. No.: 16/328,166

(22) PCT Filed: Aug. 24, 2016

(86) PCT No.: PCT/CN2016/096509
§ 371 (c)(1),
(2) Date: Feb. 25, 2019

(87) PCT Pub. No.: WO2018/035739
PCT Pub. Date: Mar. 1, 2018

(65) Prior Publication Data

US 2019/0194773 A1 Jun. 27, 2019

(51) Int. Cl.
*C21D 9/46* (2006.01)
*C22C 38/04* (2006.01)
(Continued)

(52) U.S. Cl.
CPC ..... *C21D 9/46* (2013.01); *C21D 6/005* (2013.01); *C21D 8/0205* (2013.01);
(Continued)

(58) Field of Classification Search
CPC ..... C22C 38/04; C22C 38/06; C22C 38/12; C22C 38/58; C21D 6/005; C21D 9/46;
(Continued)

(56) References Cited

U.S. PATENT DOCUMENTS 4,615,749 A 10/1986 Satoh et al.
4,708,748 A 11/1987 Satoh et al.
(Continued)

FOREIGN PATENT DOCUMENTS

CN 102828109 A 12/2012
CN 103781931 A 5/2014
(Continued)

OTHER PUBLICATIONS

English language machine translation of WO2009090231 to Weiss et al. Generated Nov. 11, 2019 (Year: 2019).*
(Continued)

*Primary Examiner* — Brian D Walck
(74) *Attorney, Agent, or Firm* — Leason Ellis LLP

(57) ABSTRACT

The invention describes a two-phase steel comprising 8-12 wt. % Mn, 0.3-0.6 wt. % C, 1-4 wt. % Al, 0.4-1 wt. % V, and a balance of Fe. The steel has martensite and retained austenite phases, and may include vanadium carbide precipitations. A method for making the two-phase steel involves the steps of (a) hot rolling the ingots of the composition to produce a plurality of thick steel sheets, (b) treating the steel sheets by an air cooling process, (c) warm rolling the steel sheets at a temperature in the range of 300-800° C. with a thicknesses reduction of 30-50%, (d) annealing the steel sheets a first time at a temperature in the range of 620-660° C. for 10-300 min, (e) cold rolling the steel sheets at room temperature with a thickness reduction of 10-30% to generate hard martensite, and (f) annealing the steel sheets a second time at a temperature in the range of 300-700° C. for 3-60 min to facilitate the partitioning of carbon and release the residual stress n martensite.

7 Claims, 5 Drawing Sheets
(2 of 5 Drawing Sheet(s) Filed in Color)

(51) Int. Cl.

| | |
|---|---|
| ***C21D 6/00*** | (2006.01) |
| ***C21D 8/02*** | (2006.01) |
| ***C22C 38/58*** | (2006.01) |
| ***C22C 38/06*** | (2006.01) |
| ***C22C 38/12*** | (2006.01) |

(52) U.S. Cl.
CPC ..... *C21D 8/0226* (2013.01); *C21D 8/0231* (2013.01); *C21D 8/0236* (2013.01); *C21D 8/0263* (2013.01); *C21D 8/0273* (2013.01); *C22C 38/04* (2013.01); *C22C 38/06* (2013.01); *C22C 38/12* (2013.01); *C22C 38/58* (2013.01); *C21D 2211/001* (2013.01); *C21D 2211/004* (2013.01); *C21D 2211/008* (2013.01)

(58) Field of Classification Search
CPC .. C21D 8/0205; C21D 8/0226; C21D 8/0231; C21D 8/0236; C21D 8/0263; C21D 8/0273
USPC ..... 148/620
See application file for complete search history.

(56) References Cited

U.S. PATENT DOCUMENTS

| | | | | |
|---|---|---|---|---|
| 5,246,898 | A | 9/1993 | Fujimaru et al. | |
| 2017/0149036 | A1* | 5/2017 | Braun | C22C 38/02 |

FOREIGN PATENT DOCUMENTS

| | | | | |
|---|---|---|---|---|
| CN | 104328360 | A | 2/2015 | |
| CN | 104379791 | A | 2/2015 | |
| CN | 105350078 | A | 2/2016 | |
| EP | 2383353 | A2 * | 11/2011 | C21D 8/02 |
| WO | WO 2009090231 | A | 4/2010 | |
| WO | WO-2015197412 | A1 * | 12/2015 | |
| WO | WO-2009090231 | * | 7/2021 | |

OTHER PUBLICATIONS

English language machine translation of CN104328360 to Luo et al. Generated Nov. 10, 2019 (Year: 2019).*

English language machine translation of EP-2383353-A2 to Reiger et al. Generated Jun. 4, 2020. (Year: 2020).*

International Search Report and Written Opinion in corresponding PCT Application No. PCT/CN2016/096509, dated May 10, 2017.

J. Shi, X, J Sun, M.Q Wang, W. JH, H. Dong, W.Q. Cao, "Enhanced work-hardening behavior and mechanical properties in ultrafine-grained steels with large-fractioned metastable austenite," Scripta Materialia, 63 (2010), pp. 815-818.

S. Lee, B. C. De Cooman, "Tensile Behavior of Intercritically Annealed 10 pct Mn Multi-phase Steel," Metallurgical and Materials Transactions A, vol. 45A, Feb. 2014, pp. 709-716.

* cited by examiner

TWO-PHASE STEEL AND METHOD FOR THE FABRICATION OF THE SAME

CROSS-REFERENCE TO RELATED PATENT APPLICATIONS

This application is a U.S. National Phase Application under 35 U.S.C. § 371 of International Patent Application No. PCT/CN2016/096509, filed Aug. 24, 2016, which is incorporated by reference in its entirety. The International Application was published on Mar. 1, 2018 as International Publication No. WO 2018/035739 A1.

FIELD OF THE INVENTION

The present invention generally relates to a two-phase steel (an ultra-strong two-phase steel), and a method for making the two-phase steel.

BACKGROUND OF THE INVENTION

The development of high-performance steels with both high strength and good ductility is driven by their wide structural application in automobiles, aviation, aerospace, power and transport. For example, the steels with high strength can offer high passenger safety in terms of crash protection, great potential in weight reduction and energy savings in the automotive industry, which is now one of the leading greenhouse gas emitters globally. Nevertheless, the high strength steels also need to possess good ductility. For instance, cold stamping technology applied in the automotive industry to fabricate the complex automotive parts requires steel with good ductility. Moreover, the combination of high strength and good ductility (i.e. uniform elongation) can provide steel with a significant gain in toughness as well as excellent resistance to fatigue. The high-performance steels include, but are not limited to the advanced high strength steels (AHSS) used in the automotive industry. Nowadays, researchers in both the automotive industry and the steel industry are pursuing the new high-performance steels to meet the demanding standards (i.e. weight reduction and energy saving) from government as well as to increase the market share.

AHSS have undergone three generations of improvements. The first generation of AHSS includes dual phase (DP) steel, transformation-induced plasticity (TRIP) steel, complex-phase (CP) steel, and martensitic (MART) steel, all of which have an energy absorption of around 20,000 MPa %. The second generation of AHSS includes twinning-induced plasticity (TWIP) steel, which has an excellent energy absorption of about 60,000 MPa %; but it has a low yield strength and may be subjected to hydrogen embrittlement. Recently, researchers have become interested in developing a third generation of AHSS, i.e. steels with energy absorption of about 40,000 MPa % and with improved yield strength.

Medium manganese (Mn) steels, which have an Mn content ranging between 3 and 12 wt. %, have the potential to meet the target of mechanical properties as required for third generation of AHSS. The article by Shi et al., "Enhanced work-hardening behavior and mechanical properties in ultrafine-grained steels with large-fractioned metastable austenite," *Scripta Materialia,* 63 (2010) pages 815-818 discloses that 5 Mn steel (Fe-0.2C-5Mn, wt. %) can have a tensile strength of 1420 MPa and a total elongation of 31%. But this 5 Mn steel has a relatively low yield strength (i.e. ~600 MPa), which limits its application in components where high yield strength is the major design criteria. In the article Lee et al., "Tensile behavior of intercritically annealed 10 pct Mn multi-phase steel" *Metallurgical and Materials Transactions,* 45A (2014), pages 749-754 proposes a 10 Mn steel (Fe-10Mn-0.3C-3Al-2Si, wt. %) which has an outstanding ductility (~65%). This exceptional tensile ductility was ascribed to the sequential operation of the TWIP and TRIP effects. Note that this 10 Mn steel also has low yield strength (~800 MPa). The underlying reason for the low yield strength of both 5 Mn and 10 Mn steels is that they contain soft ferrite as their major constituent phases (~30-70% in volume fraction) and they have no additional precipitation strengthening.

Therefore, it is important to increase the yield strength of Medium Mn steels; but, still maintain good ductility (i.e. uniform elongation) to broaden their potential structural applications.

SUMMARY OF THE INVENTION

The present invention provides a two-phase steel, in particular an ultra-strong and ductile two-phase steel, and a method for making the two-phase steel. The term "dual phase steel" is commonly used in the art to refer to a steel with a ferritic martensitic structure. However as used further in the application in reference to the present invention, the term should be taken to be the two-phase steel of martensite and retained austenite.

In an illustrative embodiment a dual-phase steel comprises or consists of 8-12 wt. % or 9-11 wt. % or 9.5-10.5 wt. % Mn, 0.3-0.6 wt. % or 0.38-0.54 wt. % or 0.42-0.51 wt. % C, 1-4 wt. % or 1.5-2.5 wt. % or 1.75-2.25 wt. % Al, 0.4-1 wt. % or 0.5-0.85 wt. % or 0.6-0.8 wt. % V, and a balance of Fe. In another embodiment of the dual-phase steel according to the present invention, the content of C is higher than 0.3 wt. % and/or the content of Al is lower than 3 wt. %.

Preferably, the dual-phase steel comprises or consists of 10 wt. % Mn, 0.47 wt. % C, 2 wt. % Al, 0.7 wt. % V, and a balance of Fe.

Still more preferably, the dual-phase steel consists of martensite and retained austenite phases.

In a further preferred embodiment a volume fraction of austenite contained in the dual-phase steel before a tensile test is 10-30%, and a volume fraction of martensite contained in the dual-phase steel before the tensile test is 70-90%.

Preferably, the volume fraction of austenite contained in the dual-phase steel before the tensile test is 15%, the volume fraction of martensite contained in the dual-phase steel before the tensile test is 85%.

Preferably, after the dual-phase steel is deformed, the volume fraction of austenite drops to 2-5%, the volume fraction of martensite increases to 95-98%.

Preferably, the volume fraction of austenite drops to 3.6%, the volume fraction of martensite increases to 96.4%.

Preferably, the dual-phase steel includes vanadium carbide precipitations with a size of about 10-30 nm.

An illustrative method for making the dual-phase steel of the present invention, comprises the steps of:

(a) providing ingots comprised of 8-12 wt. % or 9-11 wt. % or 9.5-10.5 wt. % Mn, 0.3-0.6 wt. % or 0.38-0.54 wt. % or 0.42-0.51 wt. % C, 1-4 wt. % or 1.5-2.5 wt. % or 1.75-2.25 wt. % Al, 0.4-1 wt. % or 0.5-0.85 wt. % or 0.6-0.8 wt. % V, and a balance of Fe;

(b) hot rolling the ingots to produce a plurality of thick steel sheets with a thickness of 3-6 mm, (c) treating the steel sheets by an air cooling process;

(d) warm rolling the steel sheets at a temperature of about 300-800° C. with a thicknesses reduction of 30-50%;

(e) annealing the steel sheets at a temperature of 620-660° C. for 10-300 mins;

(f) cold rolling the steel sheets at room temperature with a thicknesses reduction of 10-30% to generate hard martensite; and (g) annealing the steel sheets a second time at a temperature of 300-700° C. to form dual-phase steel.

In a preferred embodiment the starting hot rolling temperature is 1150-1300° C., and the finishing hot rolling temperature is 850-1000° C., the thickness of each steel sheet is 3-6 mm Preferably, the method includes a further and final step of cooling the steel sheets to the room temperature after the annealing process by either air or water. The dual-phase steel preferably comprises or consists of 8-12 wt. % or 9-11 wt. % or 9.5-10.5 wt. % Mn, 0.3-0.6 wt. % or 0.38-0.54 wt. % or 0.42-0.51 wt. % C, 1-4 wt. % or 1.5-2.5 wt. % or 1.75-2.25 wt. % Al, 0.4-1 wt. % or 0.5-0.85 wt. % or 0.6-0.8 wt. % V, and a balance of Fe. Still more preferable the dual-phase steel comprises or consists of 10 wt. % Mn, 0.47 wt. % C, 2 wt. % Al, 0.7 wt. % V, and a balance of Fe. In addition it is preferred that the dual-phase steel consists of martensite and retained austenite phases.

Preferably, a volume fraction of austenite contained in the dual-phase steel before a tensile test is 10-30%, a volume fraction of martensite contained in the dual-phase steel before the tensile test is 70-90%.

Preferably, the dual-phase steel includes vanadium carbide precipitations with a size of 10-30 nm.

Compared with the first and the second generation of AHSS, the operation of the TRIP effect and the TWIP effect in the dual-phase steel according to the present invention during tensile test can improve the strength and ductility of the dual-phase steel. Moreover, the formation of vanadium carbide precipitations from the reaction between the V element and the C element can improve the yield strength of the steel by precipitation strengthening.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Many aspects of the present invention can be better understood with reference to the following drawings. The components in the drawings are not necessarily drawn to scale, the emphasis instead being placed upon clearly illustrating the principles of the present invention. Moreover, in the drawings all the views are schematic and like reference numerals designate corresponding parts throughout the several views, and wherein.

DETAILED DESCRIPTION OF ILLUSTRATIVE EMBODIMENTS OF THE INVENTION

Figure 1:
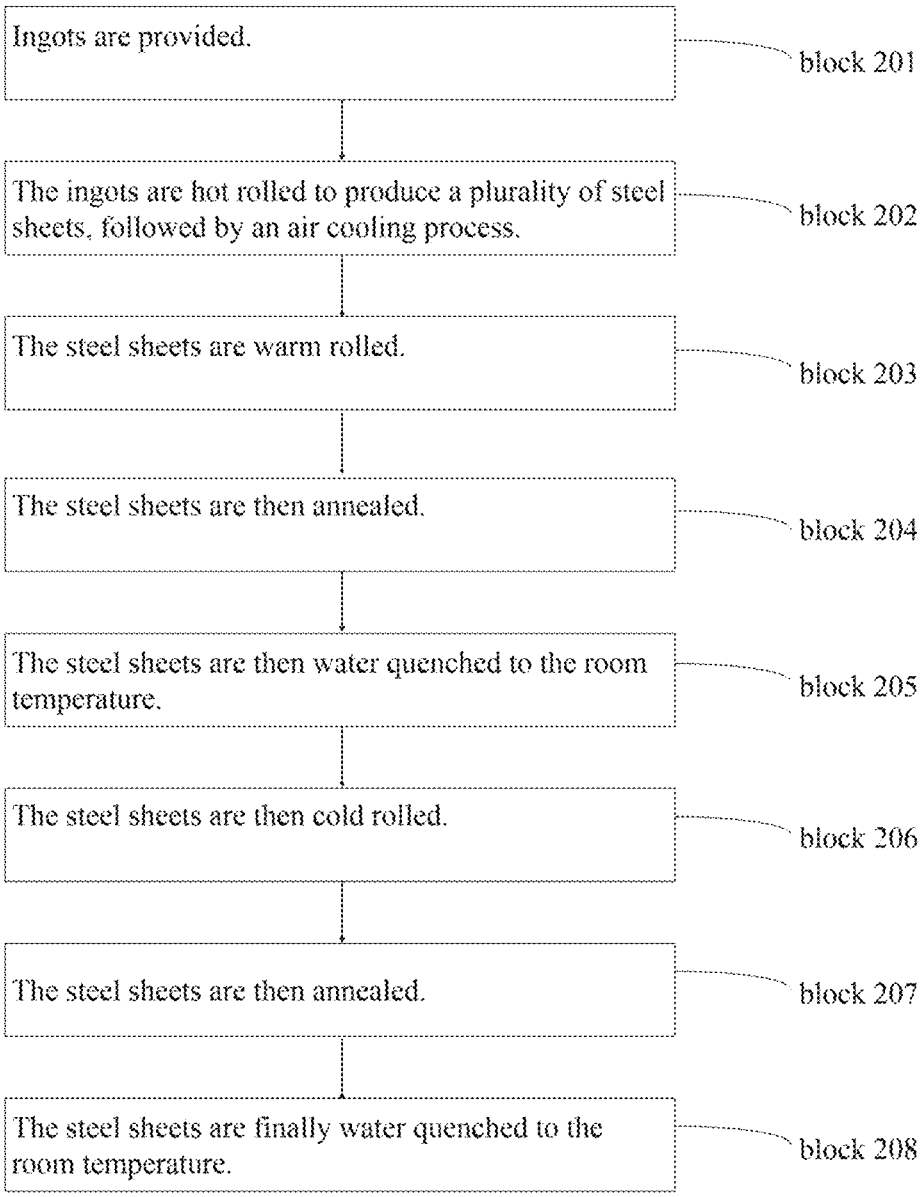
FIG. 1 is a flow chart of a method for making the dual-phase, or more precisely the two-phase steel according to an exemplary embodiment of the present invention.

The present invention is illustrated by way of example with a dual-phase, or more precisely the two-phase steel for automotive applications comprising, by weight percent: 8-12 wt. % or 9-11 wt. % or 9.5-10.5 wt. % Mn, 0.3-0.6 wt. % or 0.38-0.54 wt. % or 0.42-0.51 wt. % C, 1-4 wt. % or 1.5-2.5 wt. % or 1.75-2.25 wt. % Al, 0.4-1 wt. % or 0.5-0.85 wt. % or 0.6-0.8 wt. % V, and a balance of Fe. In a preferred exemplary embodiment, the two-phase steel comprises or consists of, by weight percent: 10 wt. % Mn, 0.47 wt. % C, 2 wt. % Al, 0.7 wt. % V, and a balance of Fe. The dual-phase steel consists of martensite and retained austenite phases. The austenite phase contained in the two-phase steel is not only metastable, but also has proper stacking fault energy, so that both the TRIP and the TWIP effects can take place gradually in the retained austenite grains.

Transformation induced plasticity or the TRIP effect can occur during plastic deformation and straining, when the retained austenite phase is transformed into martensite. Thus increases the strength of the steel by the phenomenon of strain hardening. This transformation allows for enhanced strength and ductility. Twinning induced plasticity or the TWIP effect can take place during plastic deformation and straining, when the austenite phase with proper stacking fault energy deforms by the mechanical twins. The mechanical twins can not only act as barriers, but also slip planes for the glide of lattice dislocations, therefore improving the strain hardening. Such TWIP effect can increase the strength without sacrificing the ductility of the steel.

A volume fraction of the austenite contained in the dual-phase steel before a tensile test is 10-30%, a volume fraction of martensite contained in the dual-phase steel before the tensile test is 70-90%. In at least one preferred exemplary embodiment, the volume fraction of the austenite contained in the dual-phase steel before a tensile test is 15%, and the volume fraction of martensite contained in the preferred embodiment of the dual-phase steel before the tensile test is 85%. After the tensile test, the volume fraction of the austenite drops to 2-5%, suggesting an occurrence of the TRIP effect. After tensile test, some austenite is distributed with a significant amount of mechanical twins, suggesting an occurrence of the TWIP effect. The operation of TRIP effect and TWIP effect result in a high working hardening rate, high ultimate tensile strength and good uniform elongation. In at least one more preferred exemplary embodiment, after the deformation, the volume fraction of austenite drops to 3.6%, and the volume fraction of martensite increases to 96.4%.

It is to be understood that, when the TRIP effect and TWIP effect occur in the steel they can improve the work hardening behavior of the steel. As a result, the strength of the steel can be increased without losing ductility. Furthermore, the formation of vanadium carbide precipitations during the annealing process can provide precipitation hardening to strengthen the steel.

The vanadium carbide precipitations are nano-sized, with a diameter of about 10-30 nm. Such a proper size of the precipitations can efficiently increase the strength of steel by Orowan bypassing mechanisms. The dual-phase steel can have a high yield strength, high work hardening rate, high ultimate tensile strength and good uniform elongation. Nano-sized vanadium carbide precipitations contribute to the high yield strength of the dual-phase steel.

It is to be understood that the introduction of martensite during cold rolling makes a significant contribution to the high yield strength of the dual-phase steel. It is also to be understood that the yield stress of the dual-phase steel is about 2205 MPa, the ultimate tensile strength of the dual-phase steel is about 2370 MPa, and the total elongation of the dual-phase steel is about 16.2%. See curve (a) in FIG. 3. It is noted that the uniform elongation of the dual-phase steel is almost the same as its total elongation. This is due to the collective contribution from the varied strengthening mechanisms including the TRIP effect and TWIP effect, which increase the strength and ductility simultaneously. Such large uniform elongation is desirable for making complex components using cold stamping technology.

Figure 2:
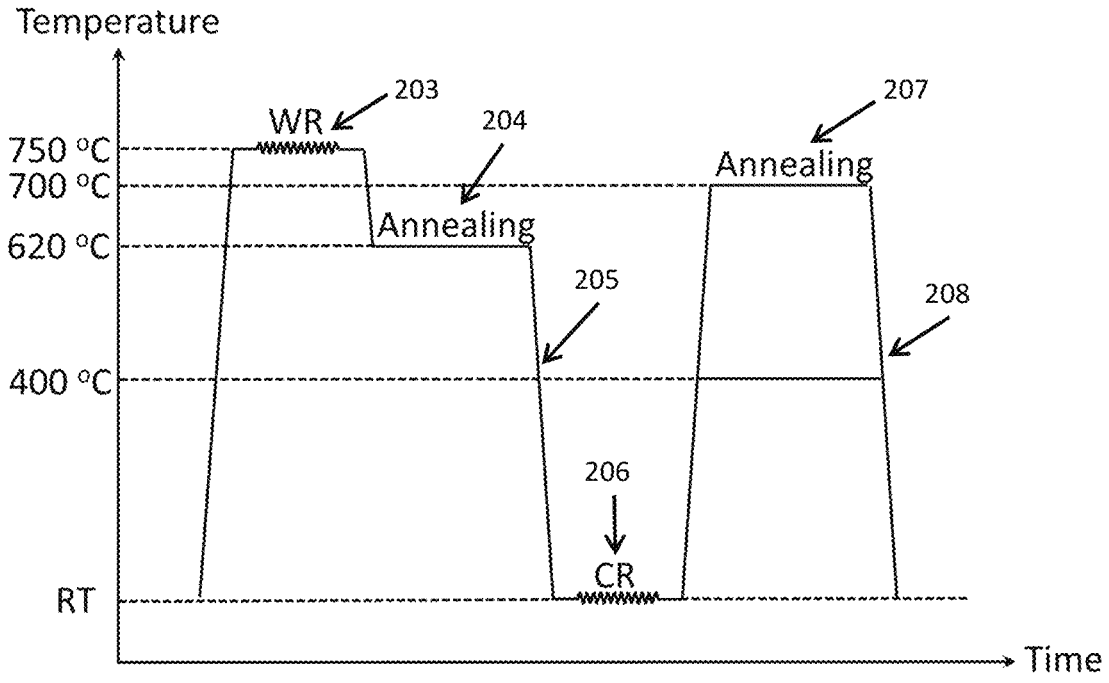
FIG. 2 is a schematic illustration of various thermo-mechanical processing routes.

Referring to FIG. 1 and FIG. 2, the invention relates to a thermo-mechanical method for making dual-phase steel. The method of FIG. 1 is provided by way of example, as there are a variety of ways to create the steel according to the present invention. Each block shown in FIG. 1 represents one or more process, method or subroutine steps carried out in the method. Furthermore, the order of blocks is illustrative only and the blocks can change in accordance with the present disclosure. Additional blocks can be added or fewer blocks can be utilized, without departing from this disclosure.

The method for making steel according to the present invention can begin at block 201 where ingots are provided. Specifically, the ingots can be prepared by using an induction melting furnace and was forged into a billet format. It is to be understood that, the ingots comprises or consists of, by weight: 8-12 wt. % or 9-11 wt. % or 9.5-10.5 wt. % Mn, 0.3-0.6 wt. % or 0.38-0.54 wt. % or 0.42-0.51 wt. % C, 1-4 wt. % or 1.5-2.5 wt. % or 1.75-2.25 wt. % Al, 0.4-1 wt. % or 0.5-0.85 wt. % or 0.6-0.8 wt. % V, and a balance of Fe. In another embodiment of the ingots according to the present invention, the content of C is higher than 0.3 wt. % and/or the content of Al is lower than 3 wt. %.

At block 202, the ingots are hot rolled to produce a plurality of 3-6 mm thick steel sheets. This rolling is followed by an air cooling process. It is to be understood that, a starting hot rolling temperature is 1150-1300° C., and a finishing hot rolling temperature is 850-1000° C. In at least one preferred exemplary embodiment, the ingot was hot rolled to the final thickness of 4 mm with entry and exit of hot rolling temperature of 1200° C. and 900° C., respectively.

At block 203, the steel sheets are warm rolled at a temperature of 300-800° C. with a thicknesses reduction of 30-50%. The warm rolling process can minimize the transformation of austenite to martensite, and can be employed to avoid the occurrence of cracks.

At block 204, the steel sheets are then annealed at a temperature of 620-660° C. for 10-300 min. The vanadium carbide precipitations are formed during this annealing process.

At block 205, the steel sheets are water quenched to the room temperature.

At block 206, the steel sheets are cold rolled at room temperature with a thicknesses reduction of 10-30%. The cold rolling may stop just after the formation of cracks at the edge of the steel sheets.

At block 207, the steel sheets are then annealed at a temperature of 300-700° C. for 3-60 min After the annealing process, there is a certain amount of the retained austenite grains, which are not only metastable, but also have the proper stacking fault energy. During tensile deformation, this retained austenite can transform to martensite or generate mechanical twins. The corresponding martensitic transformation and formation of mechanical twins provides the TRIP effect and TWIP effect, respectively, which results in a high work hardening rate, a high ultimate tensile strength and good uniform elongation.

At block 208, the steel sheets are finally water quenched to room temperature.

FIG. 2 is a temperature-time graph of the process of FIG. 1, where in the steps of FIG. 1 are indicated on the graph. The processing steps of warm rolling (203), first annealing (204), quenching to room temperature (205), cold rolling at room temperature (206), second annealing (207) and quenching (208) are indicated on FIG. 2.

It is to be understood that, after the steel sheets are cold rolled, the steel sheets can be wire-cut from the rolled sheets with the tensile axis aligned parallel to the rolling direction to achieve a plurality of tensile test samples. Tensile test samples with a gauge length of 12 mm can be tested with a universal tensile test machine.

To investigate the mechanical properties of the steel, uniaxial tensile tests were carried out at room temperature with an initial strain rate of about $5\times10^{-4}$ $s^{-1}$. Interrupted tensile tests were applied to the dual-phase steel at different engineering strains depending on the total elongation. For example, the sample used to obtain tensile curve (a) in FIG. 3 has a total elongation of 16.2% and therefore the corresponding interrupted tensile tests can be stopped at 0% strain, 5.9% strain, 11.4% strain and fracture. For microstructure observation, an electron back-scattering diffraction (EBSD) measurement was performed in an OXFORD NordlysNano EBSD detector in a JSM 7800F PRIME SEM at 25 kV. The data was processed by AZTEC software. For phase identification, X-Ray diffraction (XRD) using Cu $K_a$ radiation with a wavelength of 1.5405(6) Å was performed. The transmission electron microscopy (TEM) observation was performed in a FEI Tecnai F20 at 200 kV. The TEM sample was prepared by Twin-jet machine using a mixture of 8% perchloric acid and 92% acetic acid (vol. %) at 20° C. with a potential of 40 V.

Figure 3:
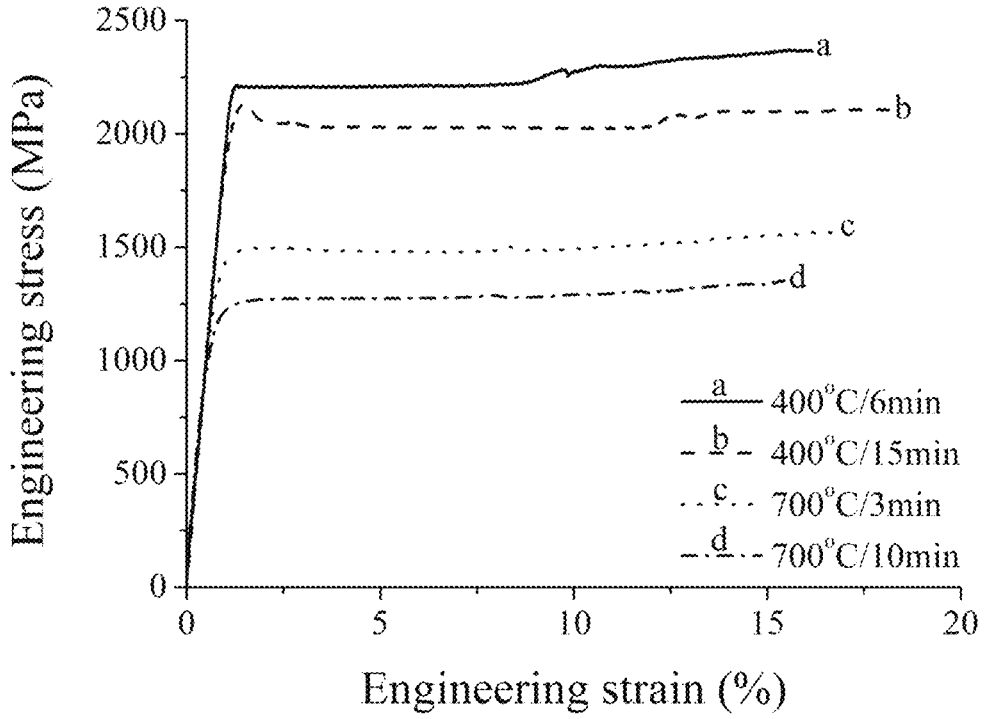
FIG. 3 shows tensile testing results of the dual-phase steels according to an exemplary embodiment of the present invention. Specifically, the samples from steel sheets used to obtain these tensile curves in FIG. 3 have a chemical composition of 10 wt. % Mn, 0.47 wt. % C, 2 wt. % Al, 0.7 wt. % V with a balance of Fe.

FIG. 3 shows the tensile results of the dual-phase steels according to an exemplary embodiment of the present invention. In detail, the samples used to obtain the tensile curves in FIG. 3 were prepared from the steel sheets which have a chemical composition of 10 wt. % Mn, 0.47 wt. % C, 2 wt. % Al, 0.7 wt. % V with a balance of Fe and were fabricated by the following steps:

(a) the steel sheets with a thickness of 4 mm were warm rolled at the temperature of about 750° C. with a thicknesses reduction of 50% down to 2 mm, (b) then the steel sheets were annealed at a temperature of about 620° C. for 300 min and were air cooled, (c) then the steel sheets were cold rolled at room temperature with a thicknesses reduction of 30% down to 1.4 mm, and (d) finally the tensile test samples were wire cut from the steel sheets and the tensile test samples were respectively annealed at a temperature of 400° C. for 6 min (referring to curve (a) of FIG. 3), at a temperature of 400° C. for 15 min (referring to curve (b) of FIG. 3), at a temperature of 700° C. for 3 min (referring to curve (c) of FIG. 3), or at a temperature of 700° C. for 10 min (referring to curve (d) of FIG. 3) and quenched by water. It seems that the annealing at 400° C. for 6 min and 15 min provide a promising combination of high tensile strength and good ductility for the steel of the present invention.

Figure 4A:
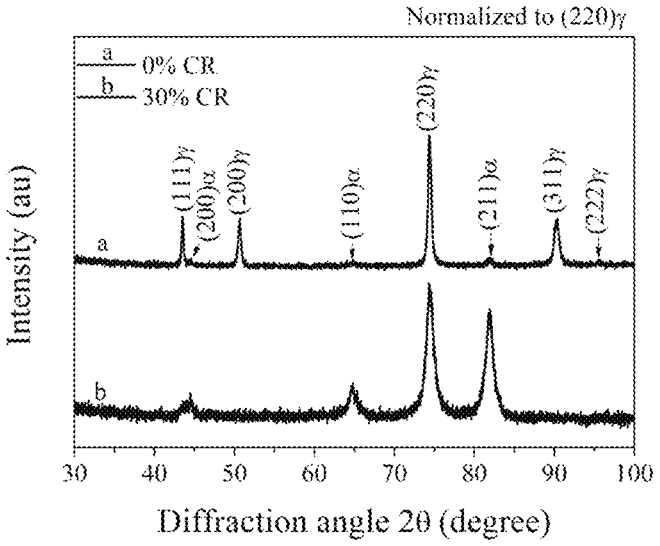
FIG. 4A presents the XRD results of the steel sheets according to the present invention prior to and after the cold rolling reduction of 30%.

FIG. 4A shows the XRD results of the steel sheets prior to cold rolling (referring to curve (a) of FIG. 4A) and after cold rolling reduction of 30% (referring to curve (b) of FIG. 4A). The austenite peaks of (111)*y*, (200)*y* and (311)*y* decrease and correspondingly the martensite peaks of (211)*a* and (110)*a* increase after the cold rolling reduction of 30%, suggesting a significant formation of martensite during the cold rolling process.

Figure 4B:
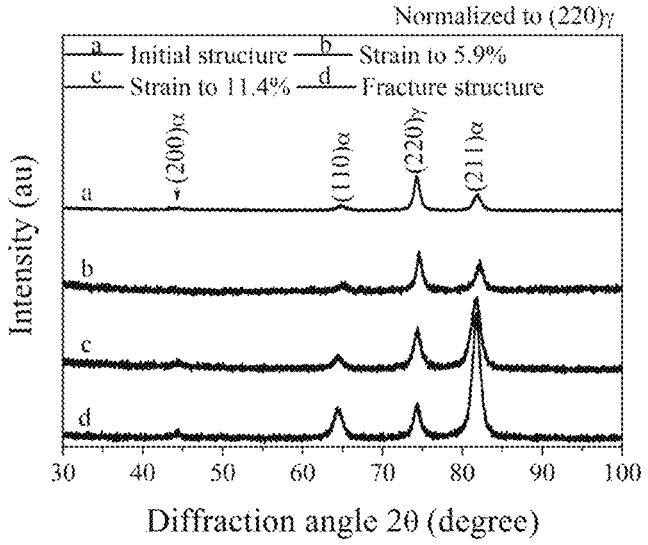
FIG. 4B presents the XRD results of the dual-phase steel used to obtain tensile curve (a) in FIG. 3 with varied strains of 0% strain, 5.9% strain, 11.4% strain and fracture.

FIG. 4B presents XRD results of the dual-phase steel used to obtain tensile curve (a) in FIG. 3 with 0% strain (referring to curve (a) of FIG. 4B), 5.9% strain (referring to curve (b) of FIG. 4B), 11.4% strain (referring to curve (c) of FIG. 4B) and fracture (referring to curve (d) of FIG. 4B). The austenite (220)*y* peak gradually decreases with strain initially and dramatically decreases at a strain larger than 5.9%, suggesting that the TRIP effect is gradually active at large strain regimes. The formation of martensite leads to the generation of additional dislocations in the surrounding austenite matrix and therefore results in localized strain hardening, which delays the onset of the necking process.

Figure 5:
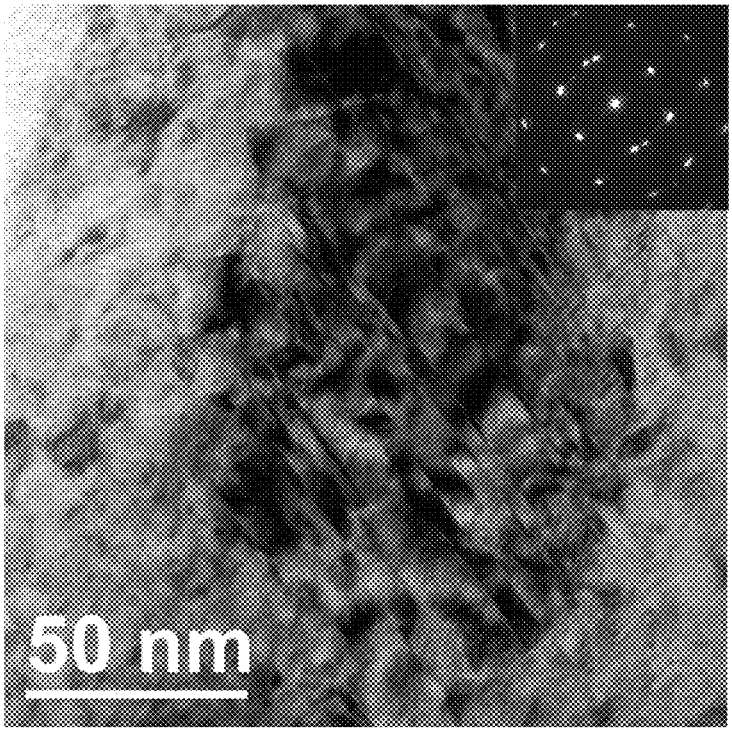
FIG. 5 is the TEM bright field image of the dual-phase steel used to obtain tensile curve (a) in FIG. 3 after tensile straining to fracture, where the upper right inset is the selected area diffraction pattern.

The formation of the mechanical twins in the retained austenite grains in the dual-phase steel used to obtain tensile curve (a) in FIG. 3 after fracture can be confirmed from TEM observation as shown in FIG. 5, where the upper right inset is a selected area diffraction pattern. The nano-twin boundaries can not only act as barriers to dislocation glide, but also act as slip planes for dislocation glide, leading to enhanced work hardening behaviour. Therefore, the TWIP effect operates in the present steel and contributes to its good uniform elongation.

Figure 6A:
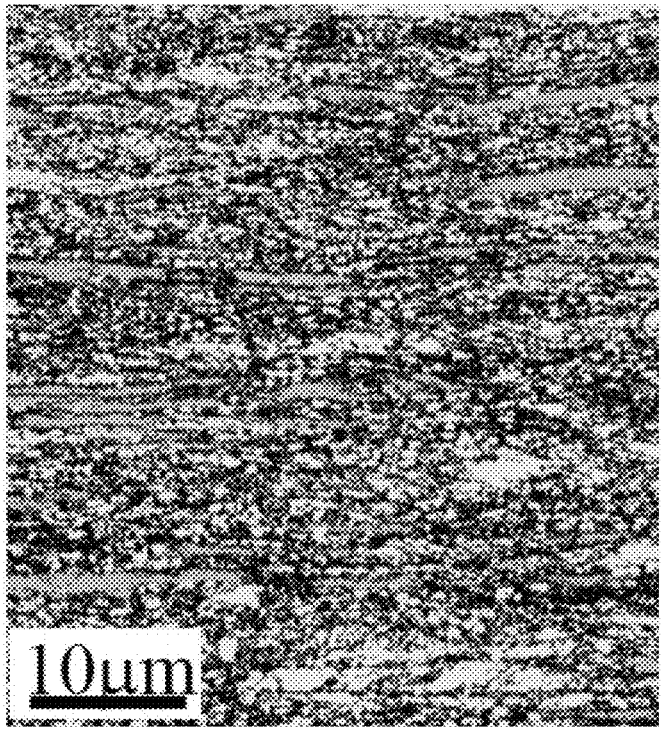
FIG. 6A and FIG. 6B are EBSD phase and orientation images of an initial microstructure of the dual-phase steel used to obtain tensile curve (a) in FIG. 3, wherein the austenite is in blue color and the martensite is in yellow color in FIG. 6A.
Figure 6B:
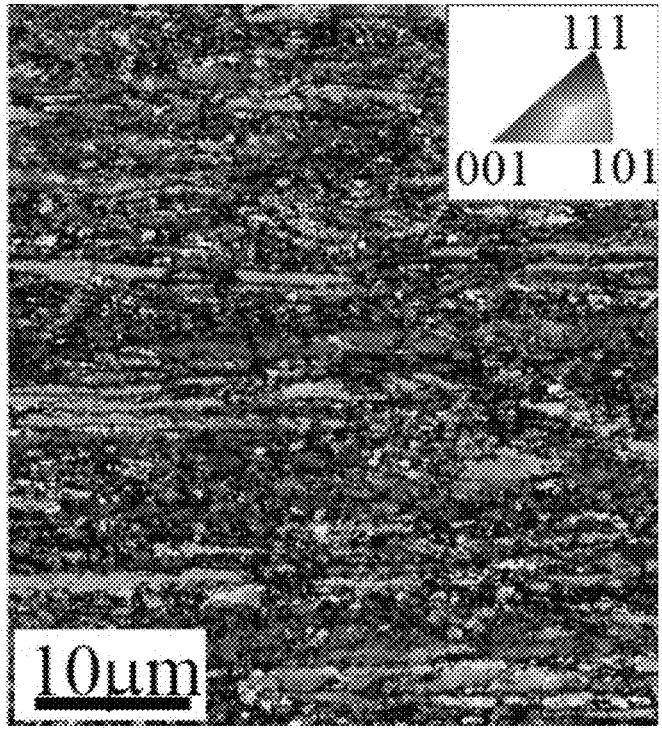

FIGS. 6A and 6B are the EBSD phase and orientation images of the initial microstructure of the dual-phase steel used to obtain tensile curve (a) in FIG. 3. FIG. 6A shows that the initial microstructure of the dual-phase steel consists of retained austenite and martensite matrix.

Figure 7:
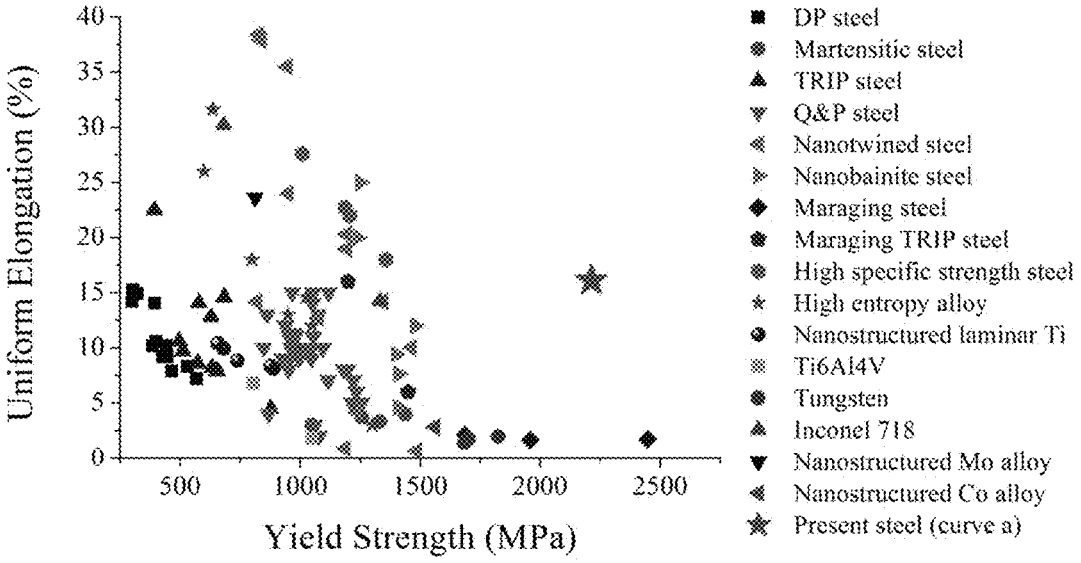
FIG. 7 is a plot of yield strength versus uniform elongation of the dual-phase steel used to obtain tensile curve (a) in FIG. 3 as compared to other high strength metals and alloys.

FIG. 7 shows the comparison between the dual-phase steel of the present invention and other high strength metals and alloys disclosed in the public literature. The data of the dual-phase steel is from the curve (a) in FIG. 3. As FIG. 7 shows, the present dual-phase steel (large red star to the lower middle right) occupies a superior position and is clearly separated from other metallic materials with respect to the yield strength and uniform elongation combination.

Although the features and elements of the present invention have been shown and described as embodiments in particular combinations, it should be understood that each feature or element can be used alone or in other various combinations within the principles of the present invention to the full extent indicated by the broad general meaning of the terms in which the appended claims are expressed. Further, various changes in form and details may be made therein without departing from the spirit and scope of the invention.

What is claimed is:

1. A two-phase steel, comprising: 8-12 wt. % Mn, 0.3-0.6 wt. % C, 1-4 wt. % Al, 0.4-1 wt. % V, and a balance of Fe, wherein a volume fraction of retained austenite phase contained in the two-phase steel before a tensile test is 10-30%, and a volume fraction of martensite phase contained in the two-phase steel before the tensile test is 70-90%; and wherein the two-phase steel has a yield strength of 1500 MPa or more.

2. The two-phase steel of claim 1, wherein the two-phase steel comprises 10 wt. % Mn, 0.47 wt. % C, 2 wt. % Al, 0.7 wt. % V, and a balance of Fe.

3. The two-phase steel of claim 1, wherein the volume fraction of austenite contained in two-phase steel before the tensile test is 15%, the volume fraction of martensite contained in the two-phase steel before the tensile test is 85%.

4. The two-phase steel of claim 1, wherein the volume fraction of austenite drops to 2-5% and the volume fraction of martensite increases to 95-98% when the two-phase steel is deformed to about 16.2% elongation at an initial strain rate of 5×10-4 s-1 at room temperature.

5. The two-phase steel of claim 1, wherein the two-phase steel includes vanadium carbide precipitations with a size of 10-30 nm.

6. The two-phase steel of claim 1, wherein the two-phase steel has an ultimate tensile strength of more than 2,000 MPa.

7. The dual-phase steel of claim 4, wherein the volume fraction of austenite drops to 3.6% and the volume fraction of martensite increases to 96.4%.

* * * * *